United States Patent [19]

Anderson

[11] 4,177,615

[45] Dec. 11, 1979

[54] FASTENING DEVICE FOR ROOF PANEL JOINTS

[75] Inventor: John W. Anderson, Bradford Woods, Pa.

[73] Assignee: H. H. Robertson Company, Pittsburgh, Pa.

[21] Appl. No.: 932,333

[22] Filed: Aug. 9, 1978

[30] Foreign Application Priority Data

Aug. 27, 1977 [ES] Spain ..... 230.787[U]

[51] Int. Cl.[2] ..... E04B 7/00; E04C 1/30; E04D 3/362; E04D 3/364

[52] U.S. Cl. ..... 52/478; 52/309.9; 52/394; 52/520; 52/528; 52/544

[58] Field of Search ..... 52/478, 520, 528, 544, 52/545, 595, 588, 309.2, 309.9, 394

[56] References Cited

U.S. PATENT DOCUMENTS

| | | | |
|---|---|---|---|
| 1,558,410 | 10/1925 | Strong | 52/520 |
| 3,462,906 | 8/1969 | Schroyer | 52/478 |
| 3,511,011 | 5/1970 | Straus | 52/478 |
| 3,555,758 | 1/1971 | Schroter | 52/309.9 |
| 3,667,180 | 6/1972 | Tischuk | 52/309.9 X |
| 3,708,943 | 1/1973 | Thomas et al. | 52/478 X |
| 3,777,430 | 12/1973 | Tischuk | 52/309.9 |
| 3,998,019 | 12/1976 | Reinwall, Jr. | 52/478 |
| 4,034,532 | 7/1977 | Reinwall, Jr. | 52/544 X |
| 4,037,377 | 7/1977 | Howell et al. | 52/309.9 |
| 4,120,123 | 10/1978 | Knudson | 52/528 X |

*Primary Examiner*—Stephen J. Novosad
*Attorney, Agent, or Firm*—Harry B. Keck; George E. Manias

[57] ABSTRACT

A fastening device for double-skin foam-core composite roof panels which present interfitted outer connectors spaced upwardly from the exterior surface of the panels, and interfitted inner connectors at the interior surface of the panels. The fastening device includes an upper end confined within the outer connectors, a base extending laterally of the upper end and overlying an exposed core surface, and a flange extending through the insulating core to the inner skin. A fastener extends through the base, the insulating core and the inner skin to secure the adjacent roof panels to a structural member.

9 Claims, 5 Drawing Figures

FASTENING DEVICE FOR ROOF PANEL JOINTS

BACKGROUND OF THE INVENTION

1. Field of the Invention

This invention is directed to joints between adjacent roof panels, and more particularly to a fastening device for securing the panels to a structural member of a building framework.

2. Description of the Prior Art

A clip-and-fastener type device for double-skin foam-core panels of the type having a hidden mating connection between the outer skins of adjacent panels is known in the art. See for example U.S. Pat. Nos. 3,667,180 (TISCHUK) and 3,777,430 (TISCHUK). The TISCHUK fastener and clip are arranged to provide a positive connection between the inner and outer skins; and to positively secure the inner skin to the subgirt.

A clip-and-fastener type device for single skin roof panels of the type having standing seam connections also is known. See for example U.S. Pat. Nos. 3,312,028 (SCHROYER), 3,462,906 (SCHROYER), and 3,998,019 (REINWALL, JR.). The clip member has an upper end confined within interfitted connectors, and a base underlying one of the roof panels and secured to a support member by means of a fastener.

A clip-and-fastener type device for a roof panel of the type comprising an insulating core secured to an outer skin and wherein an upstanding seam connection is provided between adjacent panels also is known. See for example U.S. Pat. No. 3,555,758 (SCHROTER). The clip presents an upper end confined within interfitted connectors, a vertical flange extending downwardly between the two outer skins and between the insulating cores thereof, and a base underlying the core of one panel and secured to a supporting member.

SUMMARY OF THE INVENTION

The principal object of the invention is to provide an improved fastening device having an upper end locked within interfitted outer connectors of adjacent roof panels which are located at the upper surface of the panels and having a lower end adjacent to the interfitted inner connectors and which engages one of the panels for the purpose of rigidly securing the panels to a structural member of a building framework without degrading the weathertight seal provided at the interfitted outer connectors and without degrading a vapor seal formed at the inner connectors.

The fastening device of this invention is particularly suited for use in joints between adjacent first and second composite roof panels each of which includes inner and outer metal skins which are laterally offset relative to each other, and an insulating core which connects the outer metal skin in shear-transferring relation to the inner metal skin, and wherein at one side of the panel the insulating core provides an upwardly presented exposed core surface between corresponding longitudinal edges of the skins.

The joint is characterized in that interfitted connectors which are formed along upper edges of upstanding sidewalls of the outer skins positively connect the adjacent roof panels. A fastening device of the invention is characterized by having an upper end confined within interfitted connectors, a base which extends laterally of the upper end overlying the exposed core surface, and a flange which penetrates the insulating core and has a lower end adjacent to the inner skin. A fastener extending through the base, the insulating core and the inner skin secures the adjacent roof panels to a structural member.

The joint is further characterized in that the fastening device comprises first and second clip members presenting overlying plates which constitute the base. In the preferred arrangement the first clip member includes the upper end and has its plate disposed beneath the plate of the second clip member. The second clip member presents a flange which extends downwardly through an opening in the plate of the first clip member.

The joint is further characterized in that the interfitted connectors comprise generally tubular inner and outer ribs and in that the upper end of the fastening device is correspondingly tubular.

DESCRIPTION OF THE PREFERRED EMBODIMENT(S)

Figure 1:
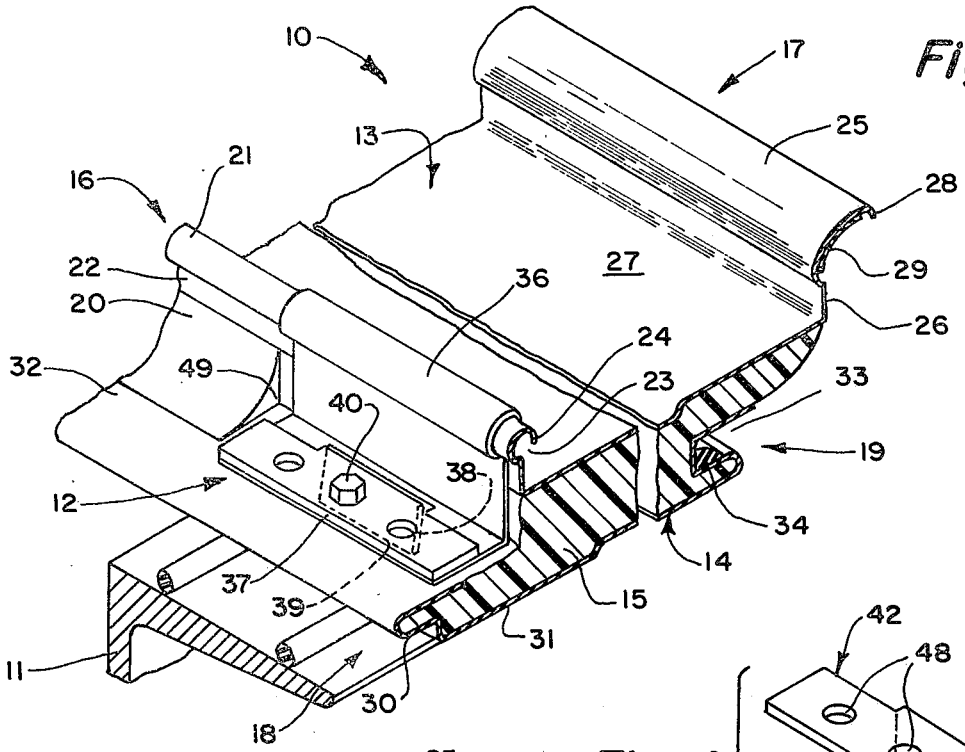
FIG. 1 is a fragmentary isometric view of a roof panel secured to a structural member by the fastening device of this invention.

FIG. 1 illustrates a composite roof panel 10 secured to a structural member 11 of the building framework by means of the fastening device 12 of this invention.

The composite panel 10 may comprise outer and inner skins 13, 14 and an insulating core 15 which connects the outer skin 13 in shear-transferring relation to the inner skin 14. The inner and outer skins 13, 14 may be formed from sheet metal having a nominal thickness of about 0.50 millimeter. The skins 13, 14 may have an embossed pattern and may have a decorative coating applied to the exterior surfaces thereof. The insulating core 15 may comprise any suitable insulating material. Preferably, the insulating core 15 comprises a foamed plastic material, such as polyurethane which is foamed-in-place between the skins 13, 14.

First and second interfitting connectors 16, 17 are provided along the opposite longitudinal edges of the outer skin 13. First and second mating elements 18, 19 are provided along the opposite longitudinal edges of the inner skin 14. The outer skin 13 is laterally offset from the inner skin 14 to improve the thermal efficiency of the joint. The insulating core 15 presents an exposed core surface 20 in the region between the first connecting means 16 and the first mating element 18. The panel 10 is thereby adapted to be secured to the structural support 11 by the fastening device 16 of this invention which penetrates the exposed core surface 20 and which is hidden from view.

The first connector 16 comprises a generally tubular inner rib 21 formed along a first sidewall 22. The tubular rib 21 comprises an incomplete circle and has a lengthwise opening 23 presented between a terminal flange 24 and the first sidewall 22 which provides communication to the interior of the inner rib 21.

The second connector 17 initially comprises an arcuate open loop 25 formed along a second sidewall 26. The open loop 25 which has an elliptical-like transverse profile extends away from the central upper web 27 and includes an in-turned terminal strip 28 extending downwardly toward the plane of the outer web 27. A relatively wide strip 29 of suitable sealant material is applied to the interior surface of and along the entire length of open loop 25.

Figure 2:
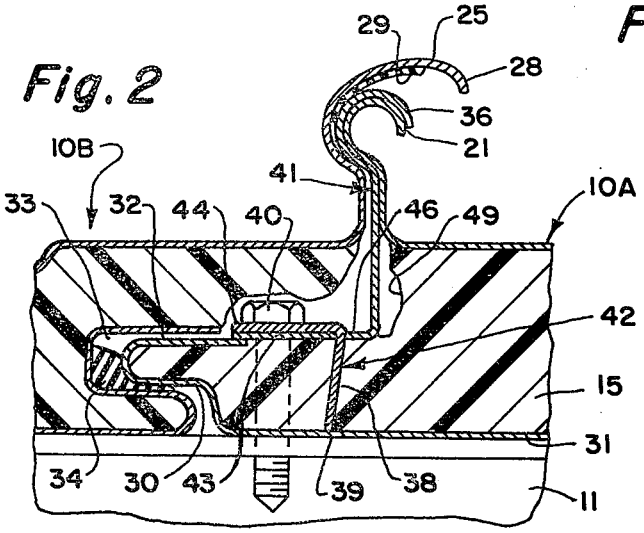
FIG. 2 is a cross-sectional view taken transversely through an incomplete joint between adjacent ones of the roof panels of FIG. 1.

When erecting adjacent panels 10A, 10B in side-by-side relation and with the loop 25 and the rib 21 interfitted as shown in FIG. 2, a suitable self-driven forming device which incorporates forming rolls is employed to bend and close the loop 25 about the rib 21. It will be observed that the arcuate open loop 25 of FIG. 2 is converted to a generally tubular outer rib which is identified at 25' in FIG. 3. The outer rib 25' and the rib 21 are securely interlocked and form an upstanding seam 35 providing a primary seal which precludes entrance of wind-driven rain or other liquids.

Figure 3:
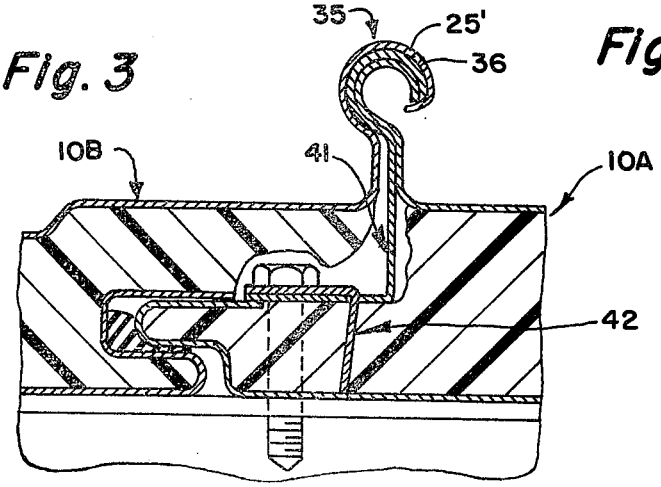
FIG. 3 is a view, similar to FIG. 2, illustrating the completed joint.

Referring to FIG. 1, the first mating element 18 comprises a tongue 30 which extends laterally outwardly of a longitudinal edge of the central inner web 31 and which includes an edge strip 32 which extends inwardly toward and supports the fastening device 12. The second mating element 19 comprises a complementary groove 33 which extends laterally inwardly of the opposite longitudinal edge and has a second sealant 34 provided along its entire length. When the adjacent roof panels 10A, 10B are assembled in side-by-side relation as shown in FIGS. 2 and 3, the tongue 30 penetrates the sealant 34 to form a secondary weather-tight seal. The tongue 30 also enters the groove 33 to provide a second positive mechanical connection between the roof panels 10A, 10B.

Referring to FIG. 1, the insulating core 15 is cut away at the exposed core surface 20 to provide a cavity 49 which facilitates installation of the fastening device 16 of this invention. The fastening device 16 comprises, in general, an upper end 36 which is generally tubular and which is fitted over the inner rib 24, a base 37 which overlies the insulating core at the cavity 44, a flange 38 which extends downwardly through the insulating core 15 and has a lower end 39 adjacent to the inner skin 31, and a fastener 40 which extends through the base 37, the insulating core 15 and the inner skin 31 to secure the fastening device 16 and the panel 10 to the structural member 11.

Figure 4:
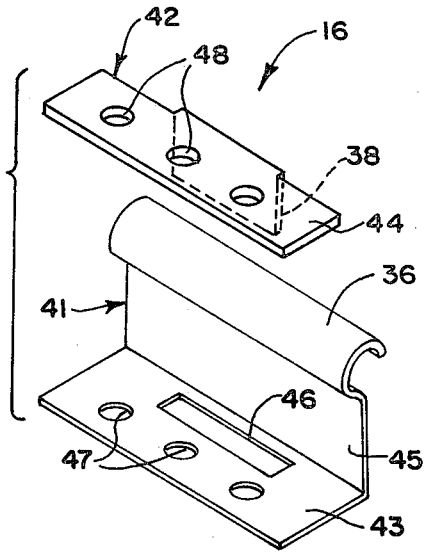
FIG. 4 is an exploded isometric view illustrating the fastening device of this invention.

The fastening device 16 (FIG. 4) preferably comprises separate clip members 41, 42 having, respectively, a lower plate 43 and an upper plate 44—the lower and upper plates 43, 44 constituting the base 37. The clip member 41 has a vertical web 45 which connects the upper tubular end 36 to the plate 43. A slot or opening 46 formed in the plate 43 is positioned to receive the flange 38 of the clip member 42. Corresponding holes 47, 48 are provided in the plates 43, 44 and positioned to receive one or more of the fasteners 40.

Figure 5:
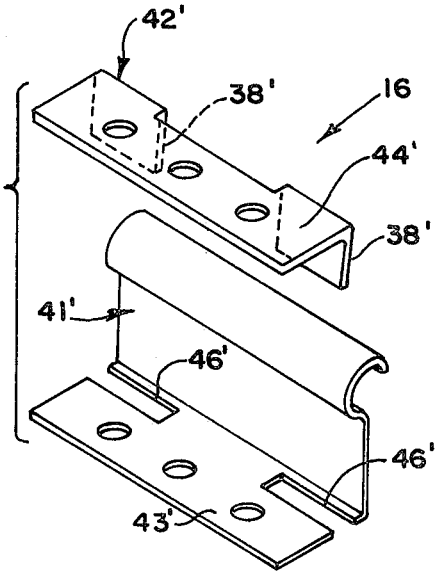
FIG. 5 is an exploded isometric view illustrating an alternative embodiment of the fastening device of this invention.

The fastening device 16 may take the form illustrated in FIG. 5 wherein the lower plate 43' is provided with spaced-apart slots 46' adapted to receive flanges 38' extending downwardly from the upper plate 44'.

The fastening device 16 of the invention is installed as follows. As shown in FIG. 2, the first clip member 41 is installed with the upper end 36 engaged over the inner rib 21; and with the lower plate 43 overlying the insulating core 15 at the cavity 49 and supported in part by the edge strip 32 of the tongue 30. Thereafter, the flange 38 of the second clip member 42 is introduced through the slot 46 and is pressed downwardly through the foam core 15 until the lower end 39 thereof is adjacent to the inner skin 31. The fastener 40 is then driven through the corresponding openings 47, 48 to secure the panel 10A to the structural member 11.

The panel 10B is then slid into place as shown in FIG. 2 and the open loop 25 is bent into the tubular shape illustrated at 25' in FIG. 3. The sealant strip 29 (not visible in FIG. 3) is compressed between the open loop 25 and the upper end 36. The panels 10A, 10B are rigidly secured to the structural member 11.

I claim:

1. A joint between adjacent first and second roof panels, wherein each panel includes inner and outer skins which are laterally offset relative to each other, and an insulating core which connects the outer skin in shear-transferring relation to the inner skin, and wherein the insulating core of the first panel provides an upwardly presented exposed core surface between corresponding longitudinal edges of the outer and inner skins, said joint comprising interfitted connectors formed along upper edges of upstanding sidewalls of the outer skins and positively connecting said first roof panel to said second roof panel; a fastening device having an upper end confined within said interfitted connectors, a base extending laterally of said upper end overlying said exposed core surface, and a flange extending downwardly through said insulating core and presenting a lower end adjacent to said inner skin; and a fastener extending through said base, said insulating core and said inner skin securing said adjacent roof panels to a structural member.

2. The joint defined in claim 1 wherein said flange is disposed between said fastener and a web which connects said upper end to said base.

3. The joint defined in claim 1 wherein said fastening device comprises separate clip members having an upper plate engaged over a lower plate, said upper and lower plates constituting said base.

4. The joint defined in claim 3 including a vertical web connecting said upper end to said lower plate.

5. The joint defined in claim 3 wherein said flange is connected to said upper plate and extends downwardly through an opening in said lower plate.

6. The joint defined in claim 1 wherein said interfitted connectors comprise generally tubular inner and outer ribs, and wherein said upper end of said fastening device is correspondingly tubular.

7. The joint defined in claim 6 wherein said inner rib has a lengthwise opening presented between a terminal flange thereof and the upper edge of the adjoining sidewall, and wherein said outer rib has a terminal strip engaged around said terminal flange and extending through said lengthwise opening thereby to positively lock said outer rib to said inner rib.

8. The joint defined in claim 1 including complementary mating elements formed along adjacent longitudinal edges of said inner skins which provide a second positive mechanical connection between said roof panels.

9. The joint defined in claim 8 wherein one of said mating elements comprises a tongue having an edge strip which extends inwardly toward said fastener and which supports an edge of said base of said fastening device.

* * * * *